US006729859B2

(12) United States Patent
Masters

(10) Patent No.: US 6,729,859 B2
(45) Date of Patent: May 4, 2004

(54) AIRFLOW GENERATING DEVICE AIR INTAKE

(75) Inventor: Steven E. Masters, Boise, ID (US)

(73) Assignee: Pro-Team, Inc., Boise, ID (US)

( * ) Notice: Subject to any disclaimer, the term of this patent is extended or adjusted under 35 U.S.C. 154(b) by 291 days.

(21) Appl. No.: 09/948,814

(22) Filed: Sep. 7, 2001

(65) Prior Publication Data

US 2003/0049141 A1 Mar. 13, 2003

(51) Int. Cl.[7] ..... F04B 17/00

(52) U.S. Cl. ..... 417/366; 310/62; 310/63; 415/172.1

(58) Field of Search ..... 417/366, 369; 415/172.1; 310/62, 63

(56) References Cited

U.S. PATENT DOCUMENTS

| | | | | | |
|---|---|---|---|---|---|
| 2,233,825 | A | * | 3/1941 | Walsh et al. | 415/218.1 |
| 3,316,848 | A | * | 5/1967 | Egger | 415/204 |
| 3,512,788 | A | * | 5/1970 | Kilbane | 277/433 |
| 3,932,070 | A | | 1/1976 | Porter et al. | 417/423 |
| 4,315,343 | A | | 2/1982 | Neroda et al. | 15/339 |
| 4,370,776 | A | * | 2/1983 | Kullik | 15/319 |
| 4,574,210 | A | * | 3/1986 | Wieland | 310/59 |
| 4,621,991 | A | | 11/1986 | Smith et al. | 417/423 |
| 4,669,952 | A | | 6/1987 | Forsyth, III et al. | 415/119 |
| 4,698,534 | A | | 10/1987 | Smith et al. | 310/89 |
| 4,808,090 | A | | 2/1989 | Evans | 417/423.2 |
| 5,350,281 | A | * | 9/1994 | Hagshenas | 417/371 |
| 5,734,214 | A | | 3/1998 | Gilliland et al. | 310/89 |
| 5,747,900 | A | * | 5/1998 | Nakamura et al. | 310/58 |
| 5,755,555 | A | | 5/1998 | Swift | 415/206 |
| 5,944,497 | A | * | 8/1999 | Kershaw et al. | 417/423.8 |
| 6,011,331 | A | * | 1/2000 | Gierer et al. | 310/58 |
| 6,037,688 | A | | 3/2000 | Gilliland et al. | 310/89 |
| 6,069,423 | A | * | 5/2000 | Miller et al. | 310/51 |
| 6,116,864 | A | * | 9/2000 | Veser et al. | 417/364 |
| 6,166,462 | A | | 12/2000 | Finkenbinder et al. | 310/63 |
| 6,411,000 | B1 | * | 6/2002 | Rew | 310/62 |
| 6,439,843 | B1 | * | 8/2002 | Finkenbinder | 415/172.1 |
| 6,488,486 | B1 | * | 12/2002 | Debleser | 417/423.8 |
| 6,599,105 | B1 | * | 7/2003 | Cahill | 417/368 |

* cited by examiner

*Primary Examiner*—Edward K. Look
*Assistant Examiner*—Vinod D. Patel
(74) *Attorney, Agent, or Firm*—Stephen M. Nipper; Frank J. Dykas; Robert L. Shaver

(57) ABSTRACT

An improved vacuum motor air intake for use on vacuum motor device with a funnel shaped shroud enclosing a portion of the vacuum motor housing adjacent a fan assembly. Combined with the funnel shaped shroud, a conical air deflection body directs air entering the motor in a laminar flow pattern.

23 Claims, 13 Drawing Sheets

AIRFLOW GENERATING DEVICE AIR INTAKE

BACKGROUND OF THE INVENTION

1. Field of the Invention

The present invention generally relates to air intakes for vacuum motors, and more particularly relates to improved vacuum motor air intakes for creating a more laminar flow into a vacuum motor housing.

2. Background Information

Various types of airflow generating devices, for example vacuum cleaner motors, are known in the prior art. Vacuum cleaner motors typically have a motor located within a housing, with the motor configured for driving a shaft. Attached to this driven shaft is an air moving diffuser plate of fan blades. The motor housing extends above and around the diffuser plate/fan blade, enclosing it and creating a compression chamber. Adjacent to the compression chamber is typically located an air intake aperture though which air is drawn into the motor housing, from which it is vented out of the bottom of the motor housing. Other types of airflow generating devices are also known in the prior art.

One of the greatest sources of inefficiency in this style of airflow generating device is turbulence. The fan is typically held onto the motor through use of a retaining means such as a nut and bolt. As airflow enters through the air intake aperture, turbulence forms as the air deflects at less than ideal angles off the nut, rotor spindle and washer surfaces, and off the flat surface of the diffuser plate/fan. What is needed is a manner of making the airflow into such an airflow-generating device housing more laminar and less turbulent.

SUMMARY OF THE INVENTION

The present invention is an improved vacuum motor air intake for use on a vacuum motor device or other airflow-generating device. The vacuum motor device has a motor, including a driven shaft, typically electrically powered, a motor housing and a fan assembly which is mounted on the drive shaft. Additionally, the motor housing has a shroud extending above and adjacent to the fan assembly enclosing a portion of the motor housing. The shroud includes an air intake aperture for allowing air to be drawn into the motor housing. This air is then moved through the vacuum motor housing and out through an exit.

One embodiment of the improved vacuum motor air intake utilizes an airflow deflection body which attaches to the vacuum motor device. This airflow deflection body is used to make airflow into and through the intake aperture and into the motor housing more laminar. In some embodiments, this airflow deflection body will be attached, either to the fan blade itself, or to the driven shaft, to the air intake aperture itself, or it may be suspended above or into the air intake aperture. Other attachments are also envisioned. Another embodiment of the improved vacuum motor air intake utilizes a cowl having a generally funnel shaped aperture for directing airflow to and through the air intake aperture and into the motor housing. This cowl attaches to the motor housing through use of a cowl attachment means. The combination airflow deflection body and the cowl serve to make airflow into and through the motor housing more laminar, less turbulent, and therefore more efficient, faster, and higher volume.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive.

DESCRIPTION OF THE PREFERRED EMBODIMENTS

Figure 1:
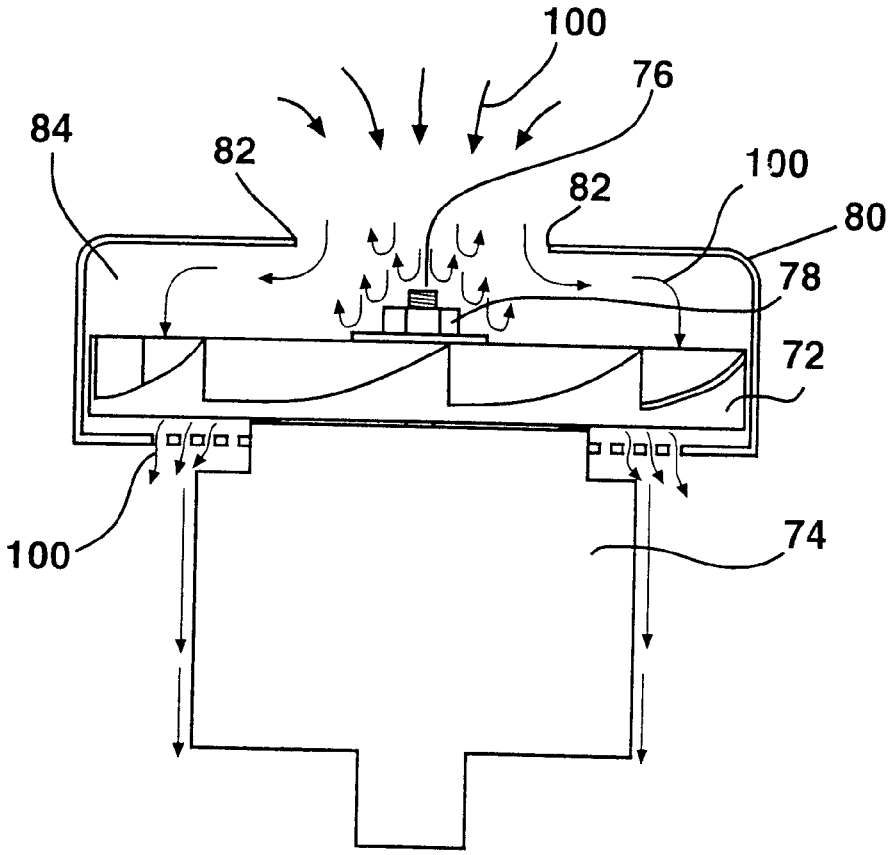
PRIOR ART FIG. 1
FIG. 1 is a cross-sectional view of a prior art vacuum motor.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

The present invention is an improved vacuum motor air intake for use on a vacuum motor device, the improved air intake providing for more laminar flow of air into and through the motor's housing.

Referring initially to FIG. 1, a prior art style of a vacuum motor is shown. The vacuum motor has a motor assembly 74 which drives a spindle 76. A fan blade or diffuser plate 72 is attached to the motor assembly through use of a nut 78 and typically a washer, which is threaded onto the threaded spindle 76. Extending from or attaching to the motor assembly 74 is a shroud cover 80 which has an air inlet 82 adjacent to the center of the diffuser plate 72. A space is formed between the shroud cover and the upper surface of the diffuser plate 72 so as to create a compression chamber 84. The rotation of the diffuser plate 72 causes air to be drawn into the inlet 82, and compresses the air within the compression chamber, thereby causing movement and exhaust of the air out of the compression chamber 84. The arrows marked as 100 shows the general airflow through such a motor and compression chamber.

One of the largest losses of efficiency with such a motor is the fact that airflow coming in through the inlet 82 is turbulent, and thus does not flow in a laminar flow. Turbulence occurs as air impacts and passes over the spindle, nut, washer, and diffuser plate upper surface. This turbulent flow impedes airflow through the motor housing, thereby decreasing the airflow. This decrease in airflow has the result of decreasing the amount of suction the vacuum motor can provide.

Figure 2:
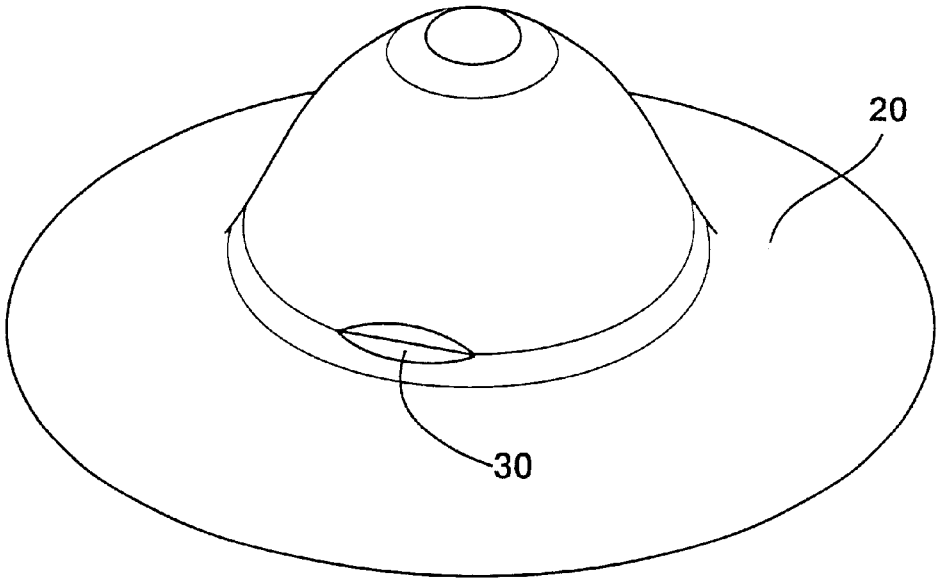
FIG. 2 is a perspective view of one embodiment of an airflow deflection body of the present invention.

Referring now to FIG. 2, one embodiment of an airflow deflection body 20 utilized in the present invention is shown. The airflow deflection body 20 serves as a means of creating a laminar flow of air through the inlet 82, and deflecting such air through the compression chamber for diffusion by the diffusion plate. The airflow deflection body 20 is configured to attach to or cover the vacuum motor's spindle and nut, thereby providing a smooth surface for the air to flow across as it is moved into and through the motor housing of the vacuum motor. A recess in the side not shown would accommodate the spindle, nut, and washer of the diffusion plate. One method of attachment is to include in the airflow deflection body shown in FIG. 2 a threaded shaft (not shown) which threads on the spindle, thus replacing the nut.

Figure 3:
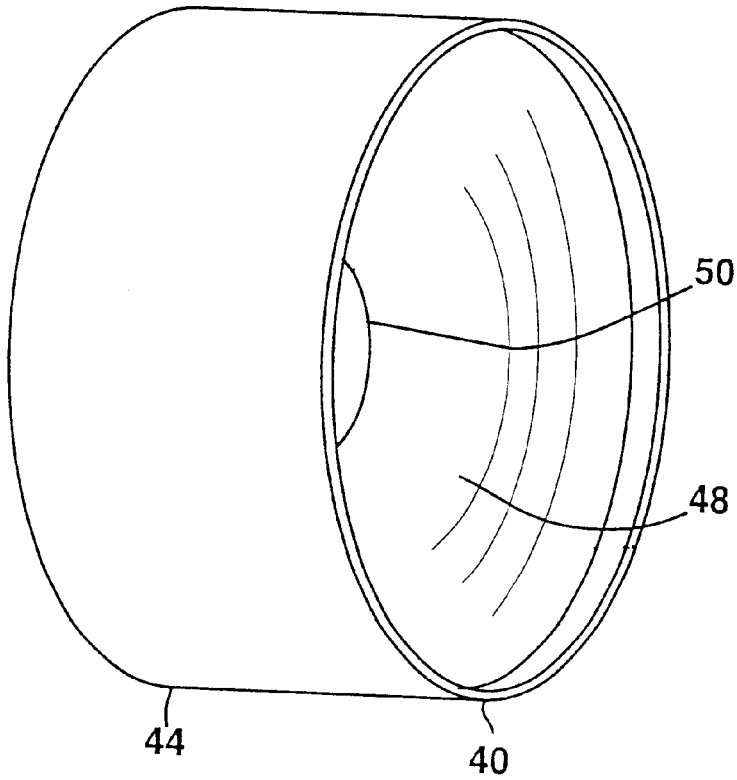
FIG. 3 is a perspective view of one embodiment of a cowl utilized with the present invention.

Referring now to FIG. 3, one embodiment of a cowl 40 utilized in the present invention is shown. This embodiment of a cowl 40 is, through use of a shroud connection 44, configured to attach to the shroud cover of a vacuum motor. This is done in such a matter that the air inlet or orifice 50 defined therein is aligned with the air inlet or orifice of the shroud cover. Leading to the orifice 50 is a direction body 48, which is generally funnel shaped, as shown. By directing airflow in such a manner into the inlet of the vacuum motor, a more laminar airflow is achieved. The shroud connection 44 can be a friction fit, can twist into a locking position, can be glued or screwed in position, and can be attached by any conventional means.

Figure 4:
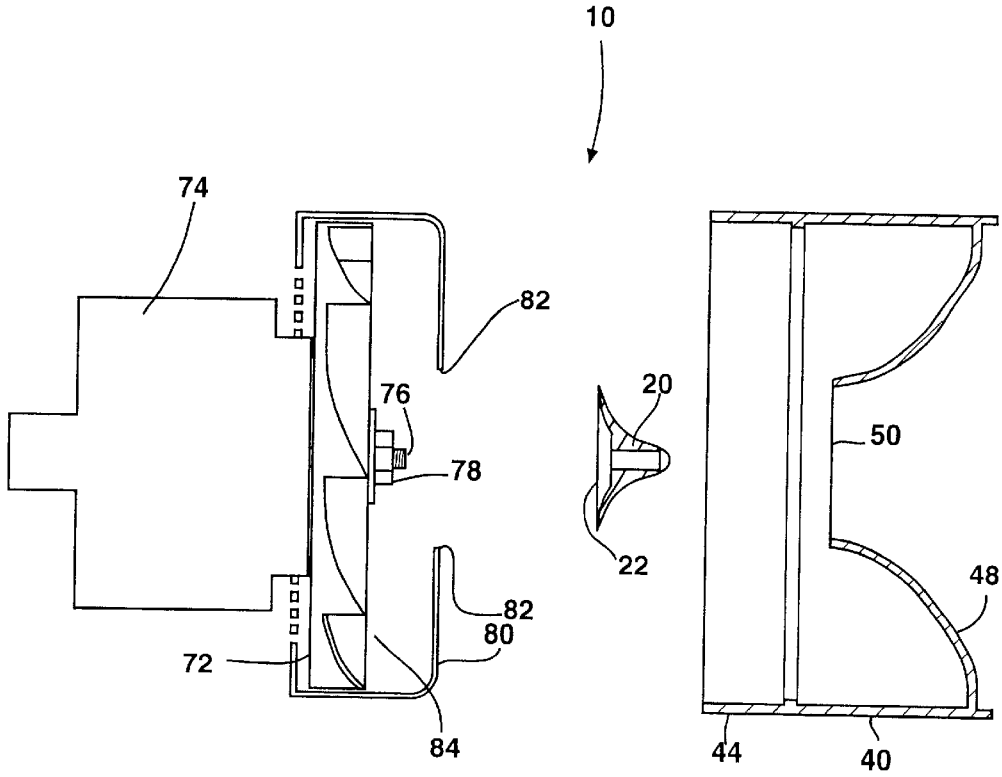
FIG. 4 is an exploded, cross-sectional view of a second embodiment of the present invention.

FIG. 4 shows a partial exploded view of the embodiment of an airflow deflection body 20 shown in FIG. 2 and a cowl embodiment shown in FIG. 3, utilized with a motor assembly 74. This motor assembly 74 has a diffuser plate 72, a shroud cover 80, and a compression chamber 84 between them. The airflow deflection body 20 is able to pass through the inlet 82 and attach to the spindle 76 and/or nut 78, through use of a nut connection 22, or other means. Examples of such attachment means include friction fits, adhesives, threading, pressing, etc. In use, airflow through the inlet 82 is more laminarly deflected past the nut and spindle, and along the flat upper surface of the diffuser plate. Optionally, a cowl 40 can be utilized to further increase the laminar flow of air through the inlet 82. The cowl embodiment shown has a shroud connection means 44 for allowing the cowl to attach through the use of a friction fit to the shroud cover and/or motor housing. Other types of shroud connections are also envisioned, such as a snap-on fitting, twist and lock, use of adhesives, threading, pressing, screwing, etc. Obviously, the cowl could also be molded in the same piece as the shroud cover 80. The direction body 48 will extend inwards for defection of air into the inlet 82 through an orifice 50 defined therein, which aligns with the inlet 82 of the shroud cowl 80. Initial testing of the version shown in FIG. 4 shows an increase in efficiency of about 8%, and eventual improvements in efficiency of 8–12% are expected with the various embodiments.

Figure 5:
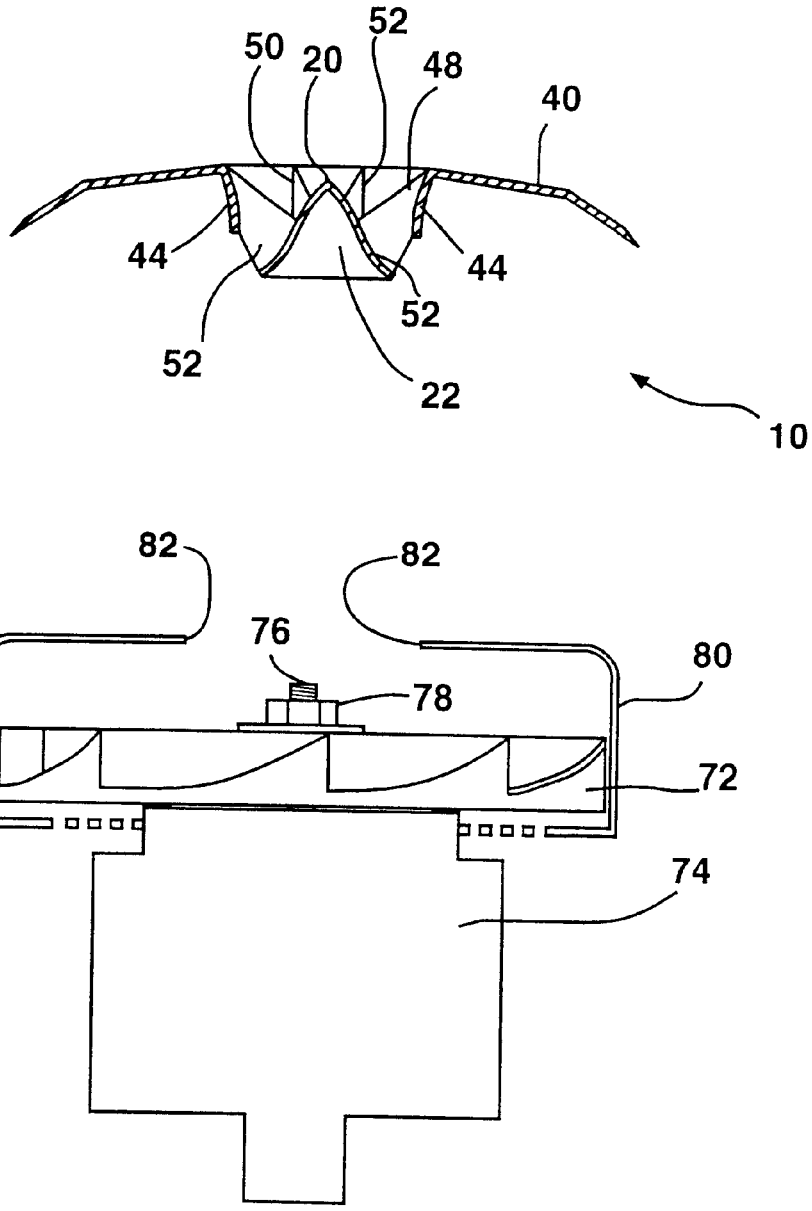
FIG. 5 is an exploded, cross-sectional view of one embodiment of the present invention.

Referring now to FIG. 5, another embodiment of the present invention 10 is shown. In this embodiment, the airflow deflection body 20, and the cowl 40 are integrated into a solitary unit. The cowl 40 has a shroud connection 44 for connecting to the inlet 82. The cowl 40 preferably also contains a number of airflow direction veins 52 for directing airflow into the inlet 82 and for attaching to and supporting the airflow deflection body 20. The cowl 40 could also be attached to the shroud at the periphery.

Figure 6:
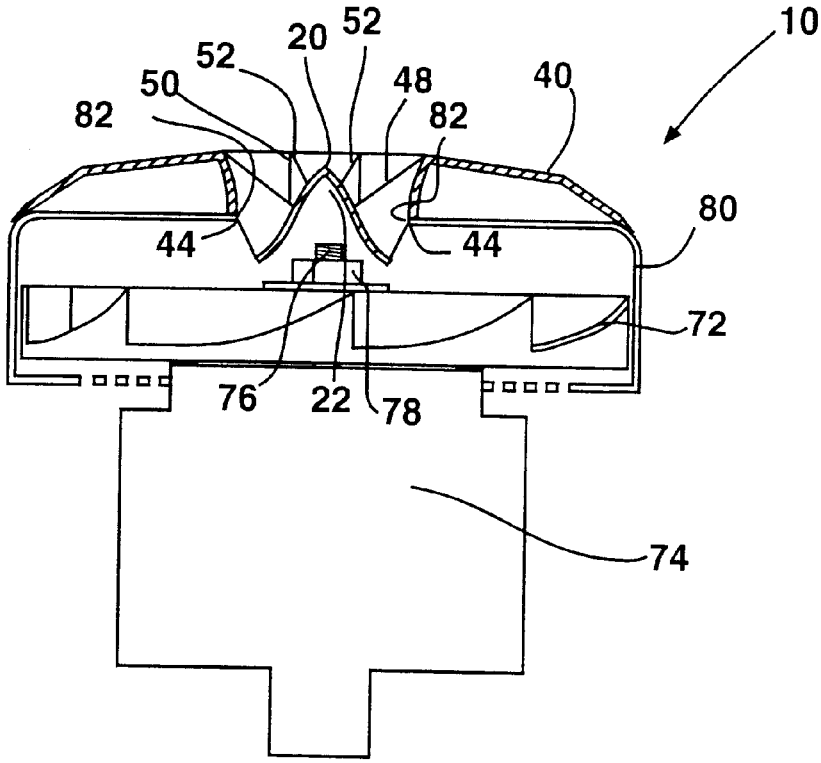
FIG. 6 is a side view of the embodiment of FIG. 5 shown assembled.

FIG. 6 shows a view of the embodiment of FIG. 5 as installed. This embodiment snaps into place over a prior art motor assembly 74 and shroud cover 80. It is thus useful as a retrofit to existing vacuum or air blowing motors. When installed as shown, the nut 78, spindle 76 and washer are shielded from interaction with incoming air. The airflow deflecting body is suspended above the nut 78, and spindle 76.

Figure 7:
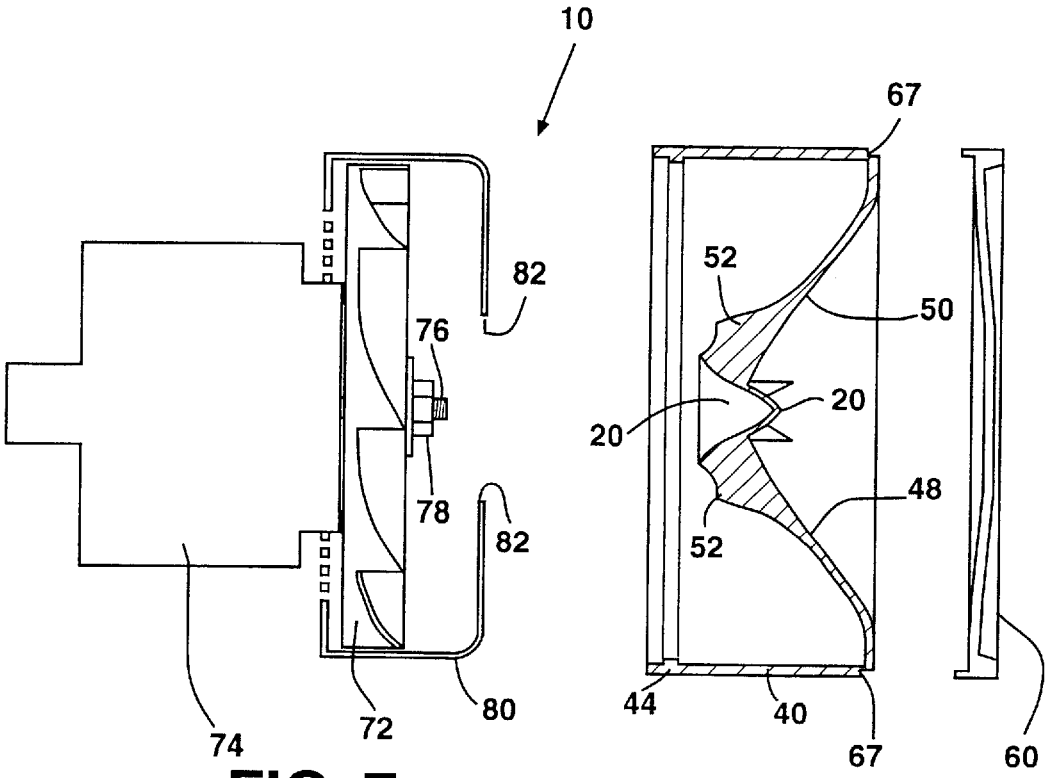
FIG. 7 is an exploded, cross-sectional view of a third embodiment of the present invention.
Figure 8:
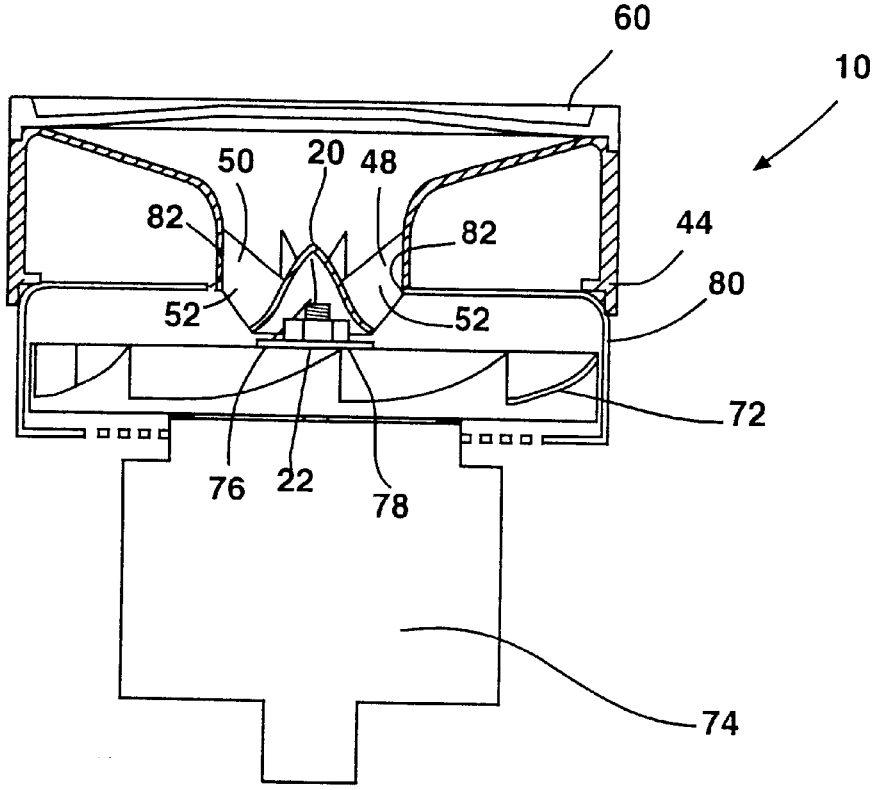
FIG. 8 is a cross-sectional view of the embodiment of FIG. 7 shown assembled.

Referring now to FIG. 7, another embodiment of the present invention 10 is shown. In this embodiment the airflow deflecting body 20 is integrally connected to the inlet 50 of the cowl 40 by a series of support vanes 48 which hold the airflow deflection body 20 suspended above the nut and washer assembly when installed, as shown in FIG. 8. A series of channeling canals are defined by the interface of the support vanes 52. The sides of the funnel inlet and the air deflecting body 20 direct the flow of incoming air away from the nut and spindle 76 and washer assembly and on to the blades of the fan assembly, thereby providing for a more laminar flow of air.

The cowl 40 further preferably comprises a dome filter connection for connection with a dome filter 60 or screen. FIG. 8 shows an embodiment mounted on a prior art motor assembly and shroud cover 80 with a dome filter 60.

The cowl containing the airflow deflecting body 20, is attached to shroud cover 80 by means of a shroud connection 44, which is configured for a friction fit over the shroud cover 80.

Figure 9:
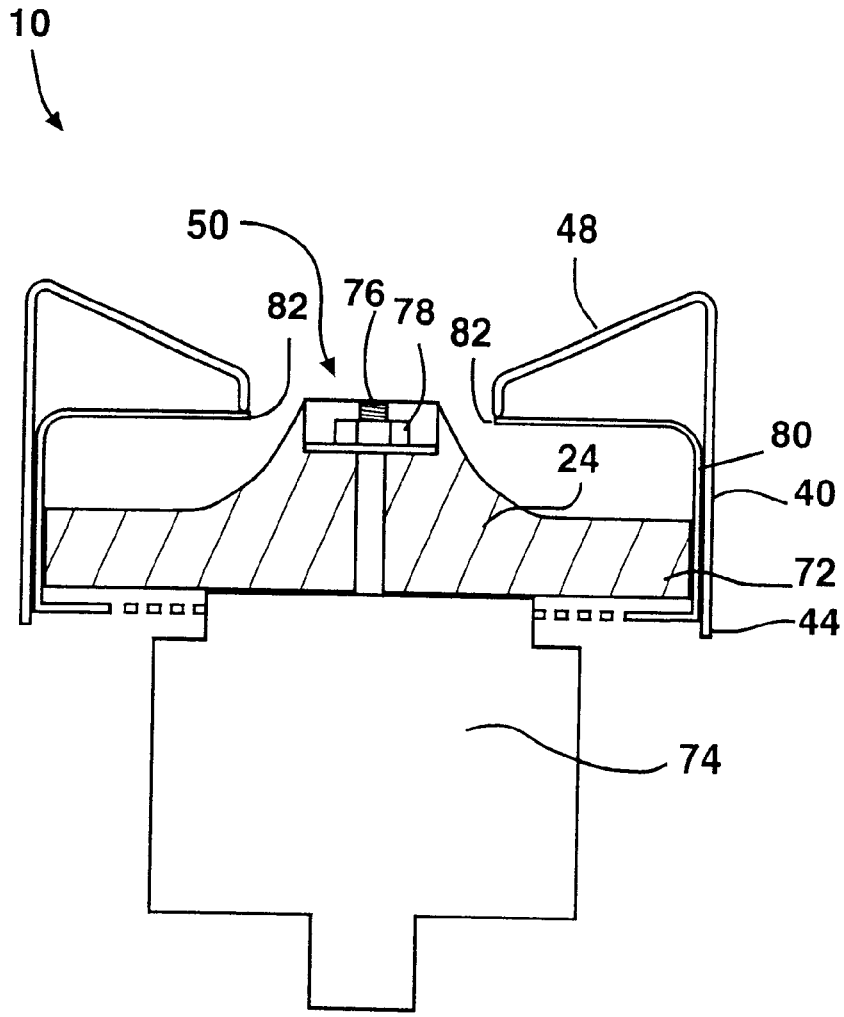
FIG. 9 is a cross-sectional view of the fourth embodiment of the present invention.

FIG. 9 showed another embodiment of the present invention. In the embodiment shown in FIG. 9, a cowl 40 is fitted over the shroud cover 80 of a motor assembly 74. The shroud cover 44 slopes from the periphery towards an orifice 50 with a direction body 48. The function of the airflow directing body is accomplished by a modification of the fan blade or diffusion plate itself, in which the fan blade is shaped to include an airflow deflection body 24. In the version shown in FIG. 9, a nut and spindle are used to hold the airflow deflection body and fan blade 24 to the spindle 76 for the motor. A further rounded conical shape insert could also be placed over the nut and the recess in which it is enclosed, to help achieve more laminar flow of air around the fan motor.

Figure 10:
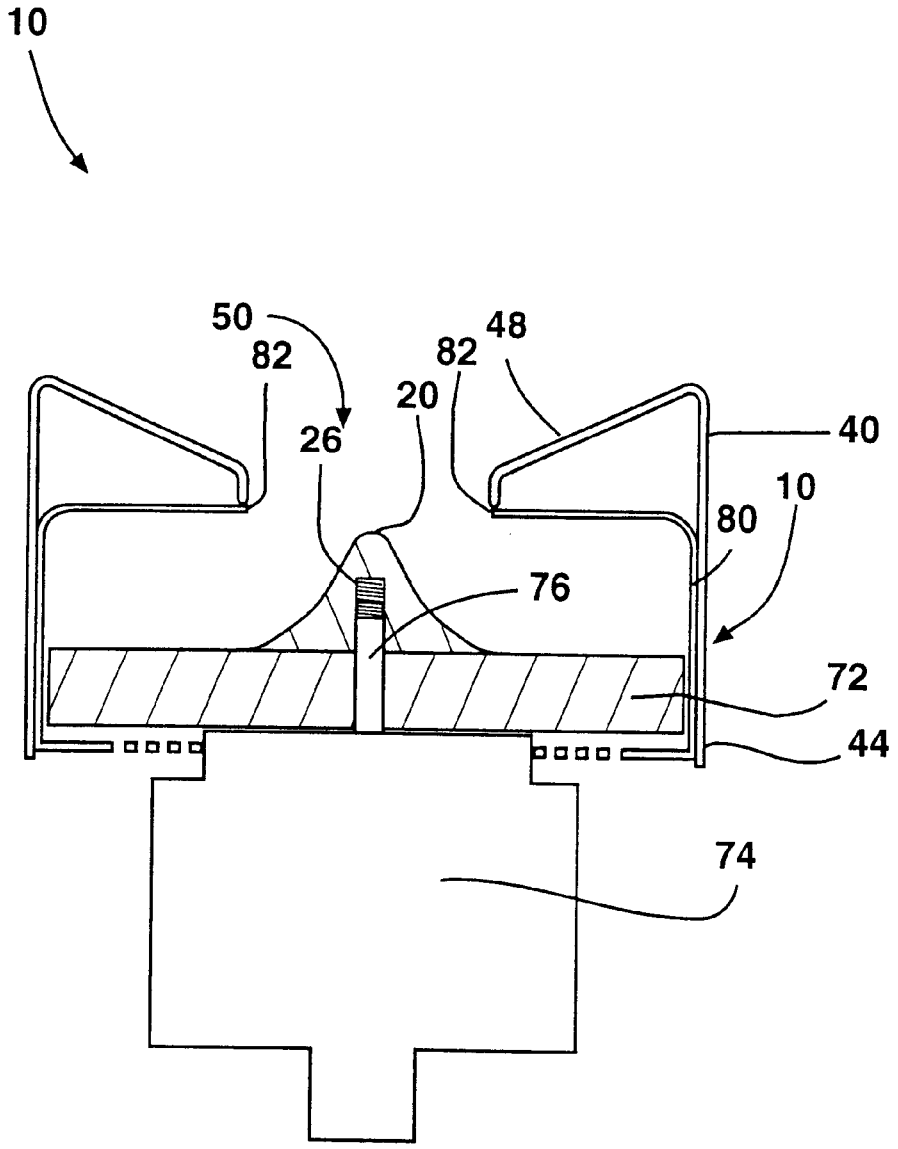
FIG. 10 is a cross-sectional view of the fifth embodiment of the present invention shown assembled.

FIG. 10 shows the cowl 44 mounted on a motor assembly 74. A direction body 48 causes air to be directed into the orifice 50. An airflow directing body 20 replaces the nut and washer and attaches to the spindle 76 by means of threads 26.

Figure 11:
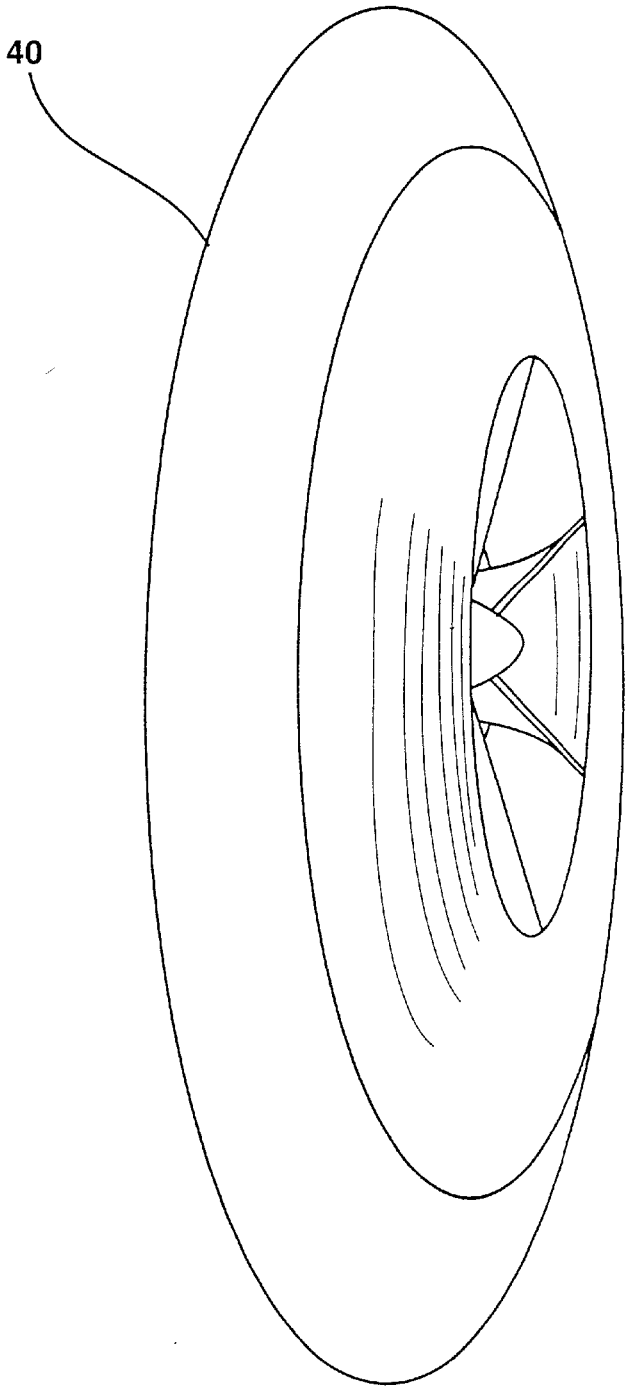
FIG. 11 is a perspective view of an embodiment of the invention.
Figure 12:
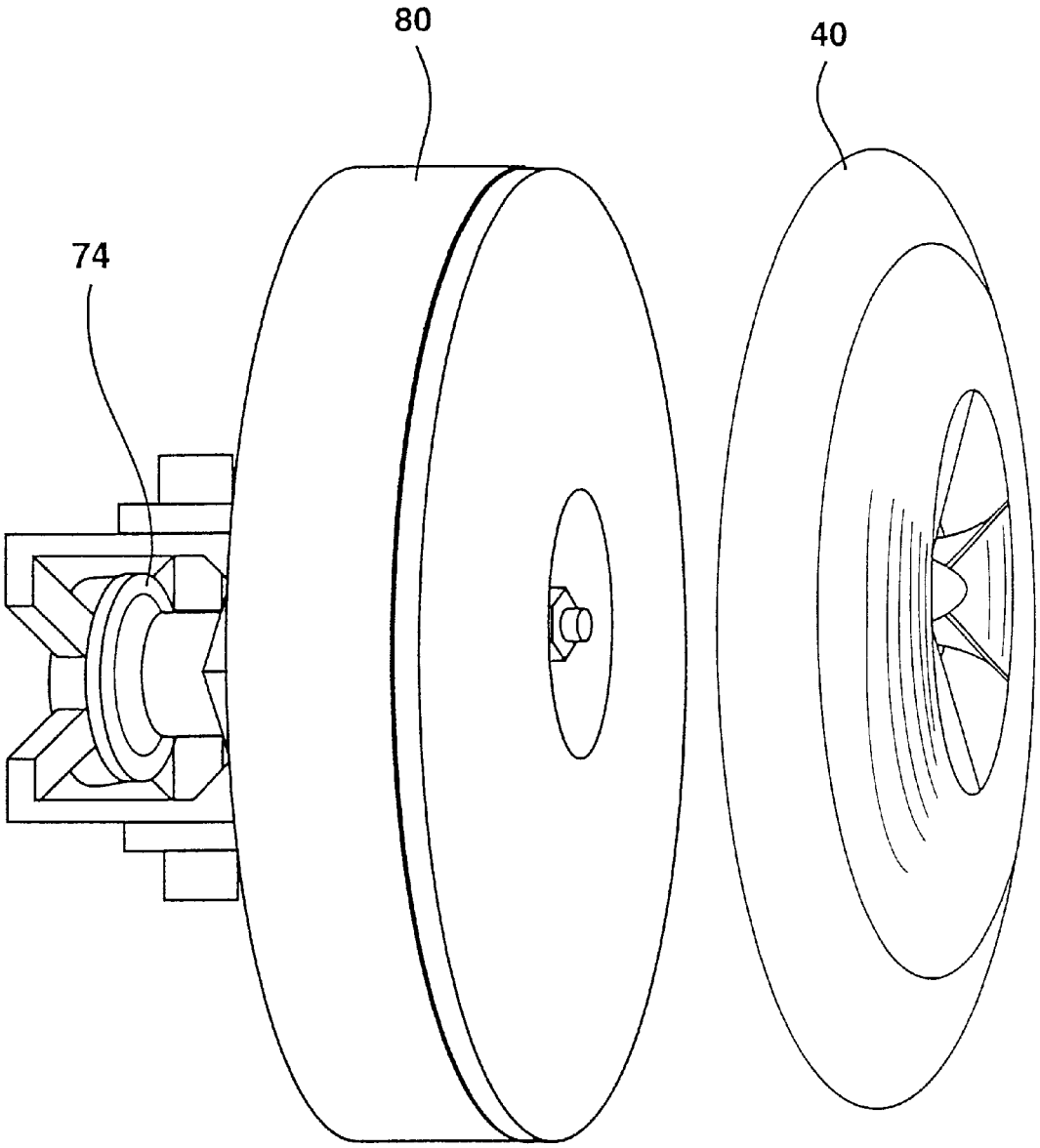
FIG. 12 is an exploded perspective view of an embodiment of the invention.
Figure 13:
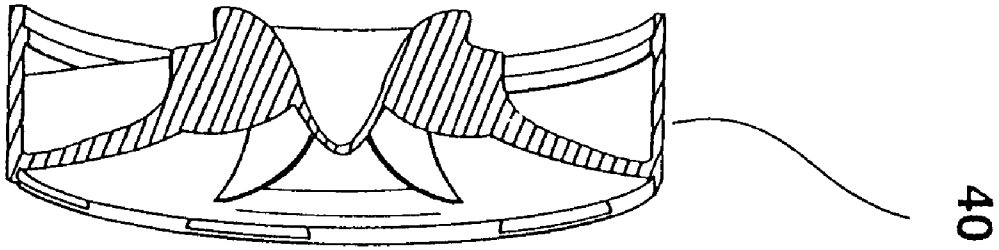
FIG. 13 is a perspective view of an embodiment of the invention.

FIGS. 11 and 12 are perspective views of a cowl 40 such as that shown in FIGS. 5 and 6. FIG. 13 is a perspective and cutaway view of a cowl 40 as shown in FIGS. 7 and 8.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. An improved vacuum motor air intake for use on a vacuum motor device, said vacuum motor device comprising a motor having a driven shaft, a motor housing and a fan assembly mounted on said driven shaft, said motor housing further comprising a shroud having an air intake aperture therethrough enclosing a portion of said motor housing adjacent to said fan assembly, the improvement comprising:

a cowl having a generally funnel shaped inner wall surrounding an aperture for directing airflow to said air intake aperture and into said motor housing, thereby making airflow through said motor housing more laminar, said cowl attaching to said motor housing through use of a cowl attachment means.

2. The vacuum motor air intake of claim 1 wherein said cowl attachment means comprises a friction fit over said motor housing.

3. The vacuum motor air intake of claim 1 wherein said cowl attachment means comprises a snap fit attachment to said air intake aperture.

4. The vacuum motor air intake of claim 1 wherein said cowl is generally tubular in shape and wherein said cowl attachment means comprises a friction fit over said motor housing.

5. An improved vacuum motor air intake for use on a vacuum motor device, said vacuum motor device comprising a motor having a driven shaft, a motor housing and a fan assembly mounted on said driven shaft, said motor housing further comprising a shroud having an air intake aperture therethrough enclosing a portion of said motor housing adjacent to said fan assembly, wherein said improved vacuum motor air intake comprises:

an airflow deflection body configured for attachment to said vacuum motor device, said airflow deflection body for making airflow through said intake aperture and into said motor housing more laminar; and a cowl having a generally funnel shaped inner wall leading to an aperture for directing airflow to said air intake aperture and into said motor housing thereby making airflow through said motor housing more laminar, said cowl attaching to said motor housing through use of a cowl attachment means.

6. The vacuum motor air intake of claim 5, wherein said airflow deflection body is generally conical in shape.

7. The vacuum motor air intake of claim 5 wherein said driven shaft is threaded and airflow deflection body is like threaded and threads onto said drive shaft as an attachment means for attaching said airflow deflection body to said driven shaft.

8. The vacuum motor air intake of claim 5 wherein said airflow deflection body attaches to said vacuum motor device by friction.

9. The vacuum motor air intake of claim 5 wherein said airflow deflection body attaches to said air intake aperture.

10. The vacuum motor air intake of claim 5 wherein said cowl attachment means comprises a friction fit over said motor housing.

11. The vacuum motor air intake of claim 5 wherein said cowl attachment means comprises an attachment to said air intake aperture.

12. The vacuum motor air intake of claim 5 wherein said cowl is generally tubular in shape and wherein said cowl attachment means comprises a friction fit over said motor housing.

13. The vacuum motor air intake of claim 5 wherein said airflow deflection body attaches to said cowl.

14. The vacuum motor air intake of claim 13 said attachment is through use of at least one support vane.

15. The vacuum motor air intake of claim 13 wherein said cowl attachment means comprises an attachment to said air intake aperture.

16. The vacuum motor air intake of claim 13 wherein said airflow deflection body attaches to said air intake aperture.

17. An improved vacuum motor air intake for use on a vacuum motor device, said vacuum motor device comprising a motor having a driven shaft, a motor housing and a fan assembly mounted on said driven shaft, wherein said improved vacuum motor air intake comprises:

an airflow deflection body configured for attachment to said vacuum motor device, said airflow deflection body for making airflow through said intake aperture and into said motor housing more laminar; and a shroud for said motor housing, said shroud having a generally flattened funnel shaped inner wall surrounding an aperture, for directing airflow through said air intake aperture and into said motor housing thereby making airflow through said motor housing more laminar, said shroud attaching to said motor housing.

18. An improved vacuum motor air intake for use on a vacuum motor device, said motor device comprising;

a motor having a driven shaft;

a motor housing a fan assembly mounted on said driven shaft by an attachment means said motor housing further comprising a shroud having an air intake aperture therethrough enclosing a portion of said motor housing adjacent to said fan assembly, the improvement comprising:

a cowl having a generally funnel shaped inner wall surrounding an aperture for directing airflow through said air intake aperture and into said motor housing, thereby making airflow through said motor housing more laminar, said cowl attaching to said motor housing through the use of a cowl attachment means.

19. The cowl of claim 18 wherein a generally conical air deflection device is suspended by at least one vane from said funnel shaped inner wall of said cowl, and which is suspended above said attachment means of said fan assembly.

20. The cowl of claim 18 wherein said cowl further comprises a dome filter mounted distal to said aperture on said funnel shaped inner wall.

21. The cowl of claim 18 wherein said funnel shaped aperture extends through the air intake aperture of said motor housing and said air deflection device proximately covers said drive shaft fan assembly attachment means.

22. An improved vacuum motor air intake for use on a vacuum motor device, said vacuum motor device comprising a motor having a driven shaft, a motor housing and a fan assembly mounted on said driven shaft, said motor housing further comprising a shroud having an air intake aperture therethrough enclosing a portion of said motor housing adjacent to said fan assembly, wherein said improved vacuum motor air intake comprises:

an airflow deflection body configured for attachment to said vacuum motor device by friction, said airflow deflection body for making airflow through said intake aperture and into said motor housing more laminar.

23. The air intake of claim 22 wherein said airflow deflection body is generally conical in shape.

* * * * *